US008778853B2

(12) United States Patent
Li

(10) Patent No.: US 8,778,853 B2
(45) **Date of Patent: *Jul. 15, 2014**

(54) GLYCEROL-CONTAINING FUNCTIONAL FLUID

(75) Inventor: Yue-Rong Li, Albany, CA (US)

(73) Assignee: Chevron Oronite Company LLC., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/294,269

(22) Filed: Nov. 11, 2011

(65) Prior Publication Data

US 2013/0157908 A1 Jun. 20, 2013

(51) Int. Cl.

| | |
|---|---|
| ***C10M 129/04*** | (2006.01) |
| ***C10M 137/10*** | (2006.01) |
| ***C10M 159/24*** | (2006.01) |
| ***C10M 129/76*** | (2006.01) |

(52) U.S. Cl.
USPC ..... 508/175; 508/369; 508/391; 508/501

(58) Field of Classification Search
CPC ..... C10M 2207/028; C10M 2207/262; C10M 2219/046; C10M 2207/02
USPC ..... 508/369, 501, 391
See application file for complete search history.

(56) References Cited

U.S. PATENT DOCUMENTS

| | | | | |
|---|---|---|---|---|
| 5,114,603 | A | 5/1992 | Kennedy et al. | |
| 2005/0026790 | A1 * | 2/2005 | Komatsubara et al. | 508/160 |
| 2007/0078068 | A1 | 4/2007 | Askew | |
| 2008/0176777 | A1 * | 7/2008 | Milner et al. | 508/382 |
| 2010/0144565 | A1 | 6/2010 | Ikeda et al. | |

* cited by examiner

*Primary Examiner* — Vishal Vasisth
(74) *Attorney, Agent, or Firm* — Carlton Virassammy; Claude J. Caroli

(57) ABSTRACT

A functional fluid comprising a major amount of an oil of lubricating viscosity, and at least about 0.05 wt-% glycerol. A method of preparing a functional fluid comprising adding glycerol to a functional fluid, wherein the glycerol is not glycerol monooleate. A method of preparing an additive concentrate comprising adding glycerol to a diluent oil wherein the concentrate contains from about 1% to about 99% by weight of said diluent. A method of reducing wear comprising contacting a metal surface with a functional fluid comprising a major amount of an oil of lubricating viscosity and at least about 0.05 wt-% glycerol.

16 Claims, No Drawings

GLYCEROL-CONTAINING FUNCTIONAL FLUID

FIELD OF INVENTION

The present invention relates to functional fluids useful in systems requiring power transmission fluids, hydraulic fluids and/or lubrication of moving parts. In particular, the present invention relates to a functional fluid containing an organic wear inhibitor for use in tractor hydraulic fluids.

BACKGROUND OF THE INVENTION

Modern lubricating oil formulations are formulated to exacting specifications often set by original equipment manufacturers. To meet such specifications, various additives are used, together with base oil of lubricating viscosity. Depending on the application, a typical lubricating oil composition may contain dispersants, detergents, anti-oxidants, wear inhibitors, rust inhibitors, corrosion inhibitors, foam inhibitors, and friction modifiers just to name a few. Different applications will govern the type of additives that will go into a lubricating oil composition.

A functional fluid is a term which encompasses a variety of fluids including but not limited to tractor hydraulic fluids, power transmission fluids including automatic transmission fluids, continuously variable transmission fluids and manual transmission fluids, hydraulic fluids, including tractor hydraulic fluids, gear oils, power steering fluids, fluids used in wind turbines and fluids related to power train components. It should be noted that within each of these fluids such as, for example, automatic transmission fluids, there are a variety of different types of fluids due to the various transmissions having different designs which have led to the need for fluids of markedly different functional characteristics.

With respect to tractor hydraulic fluids, these fluids are all-purpose products used for all lubricant applications in a tractor except for lubricating the engine. Also included as a tractor hydraulic fluid for the purposes of this invention are so-called Super Tractor Oil Universal fluids or "STOU" fluids, which also lubricate the engine. These lubricating applications may include lubrication of gearboxes, power take-off and clutch(es), rear axles, reduction gears, wet brakes, and hydraulic accessories. The components included within a tractor fluid must be carefully chosen so that the final resulting fluid composition will provide all the necessary characteristics required in the different applications. Such characteristics may include the ability to provide proper frictional properties for preventing wet brake chatter of oil immersed brakes while simultaneously providing the ability to actuate wet brakes and provide power take-off (PTO) clutch performance. A tractor fluid must provide sufficient antiwear and extreme pressure properties as well as water tolerance/filterability capabilities. The extreme pressure (EP) properties of tractor fluids, important in gearing applications, may be demonstrated by the ability of the fluid to pass a spiral bevel test as well as a straight spur gear test. The tractor fluid may need to pass wet brake chatter tests while providing adequate wet brake capacity when used in oil immersed disk brakes which are comprised of a bronze, graphitic-compositions and asbestos. The tractor fluid may need to demonstrate its ability to provide friction retention for power shift transmission clutches such as those clutches which include graphitic and bronze clutches.

When the functional fluid is an automatic transmission fluid, the automatic transmission fluids must have enough friction for the clutch plates to transfer power. However, the friction coefficient of fluids has a tendency to decline due to the temperature effects as the fluid heats up during operation. It is important that the tractor hydraulic fluid or automatic transmission fluid maintain its high friction coefficient at elevated temperatures, otherwise brake systems or automatic transmissions may fail.

A need exists for an alternative organic wear inhibitor for use in tractor hydraulic fluids that maintains the protection of gears at slow speeds.

JP05-105895 teaches lubricating oil compositions for wet clutches and brakes used in power transmission units in among other uses in agricultural, construction, and other industrial machinery, containing 0.01-10 parts by weight of a C2-C14 aliphatic compound having two or more hydroxyl groups per 100 parts by weight of a base oil. In particular JP05-105895 teaches such oils are especially useful as transmission fluids. Glycerol is disclosed as such a C2-C14 aliphatic compound having two or more hydroxyl groups but is not exemplified.

Bayles, Jr. et al., U.S. Pat. No. 5,284,591, is directed to a multipurpose functional fluid which is comprised of a major amount of a hydrocarbon oil and a minor amount, sufficient to improve characteristics of the fluid of a novel additive. The additive is comprised of a calcium salt complex, a group II metal dithiophosphate salt, a borated epoxide, a carboxylic solubilizer and a sulfurized composition.

Stoffa et al., U.S. Pat. No. 5,635,459 is directed to a function fluid composition having improved gear performance which comprises an oil of lubricating viscosity, and added thereto (a) an alkali or alkaline earth metal salt complex in the form of borated and/or non-borated salts; (b) an EP/antiwear agent comprising a mixture of zinc salts of dialkylphosphorodithioic acid and 2-ehtylhexanoic acid heated with triphenyl phosphite or an olefin; and (c) a borated epoxide.

SUMMARY OF THE INVENTION

The present invention is directed to a functional fluid comprising a major amount of an oil of lubricating viscosity and at least about 0.05 wt-% glycerol.

The present invention is directed to a functional fluid comprising a major amount of an oil of lubricating viscosity; at least about 0.05 wt % glycerol;

at least about up to 5.0 wt % of at least one low overbased sulfonate detergent;

at least about up to 5.0 wt % of at least one high overbased sulfonate detergent;

at least about up to about 3.0 wt % of at least one medium overbased phenate detergent; at least about up to 3.0 wt % of at least one high overbased phenate detergent; at least about up to 2.0 wt % of at least one medium overbased carboxylate detergent and at least one antiwear additive.

The present invention is directed to a method of preparing a functional fluid comprising adding glycerol to a functional fluid, wherein the glycerol is not glycerol monooleate.

The present invention is directed to a method of preparing an additive concentrate comprising adding glycerol to a diluent oil wherein the concentrate contains from about 1% to about 99% by weight of said diluent.

The present invention is directed to a method of reducing wear comprising contacting a metal surface with a functional fluid comprising a major amount of an oil of lubricating viscosity and at least about 0.05 wt-% glycerol.

DETAILED DESCRIPTION OF THE INVENTION

Prior to discussing the present invention in detail, the following terms will have the following meanings unless expressly stated to the contrary.

Definitions

The term "alkaline earth metal" refers to calcium, barium, magnesium, strontium, or mixtures thereof.

The term "alkyl" refers to both straight- and branched-chain alkyl groups.

The term "metal" refers to alkali metals, alkaline earth metals, transition metals or mixtures thereof.

The term "Metal to Substrate ratio" refers to the ratio of the total equivalents of the metal to the equivalents of the substrate. An overbased sulphonate detergent typically has a metal ratio of 12.5:1 to 40:1, in one aspect 13.5:1 to 40:1, in another aspect 14.5:1 to 40:1, in yet another aspect 15.5:1 to 40:1 and in yet another aspect 16.5:1 to 40:1.

TBN numbers reflect more alkaline products and therefore a greater alkalinity reserve. The TBN of a sample can be determined by ASTM Test No. D2896 or any other equivalent procedure. In general terms, TBN is the neutralization capacity of one gram of the lubricating composition expressed as a number equal to the mg of potassium hydroxide providing the equivalent neutralization. Thus, a TBN of 10 means that one gram of the composition has a neutralization capacity equal to 10 mg of potassium hydroxide. TBN of the actives should be measured.

The term "low overbased" or "LOB" refers to an overbased detergent having a low TBN of the actives of about 0 to about 60.

The term "medium overbased" or "MOB" refers to an overbased detergent having a medium TBN of the actives of greater than about 60 to about 200.

The term "high overbased" or "HOB" refers to an overbased detergent having a high TBN of the actives of greater than about 200 to about 400.

As stated above, the present invention provides a method of improving the brake and clutch capacity of a functional fluid by adding an antiwear improving amount of glycerol to the functional fluid.

Functional Fluids

The functional fluids of the present invention use base oils derived from mineral oils, synthetic oils or vegetable oils. A base oil having a viscosity of at least about 2.5 cSt at about 40° C. and a pour point below about 20° C., preferably at or below 0° C., is desirable. The base oils may be derived from synthetic or natural sources. Base oils may be derived from any of one or combination of Group I through Group V base stocks as defined in American Petroleum Institute Publication 1509, which is herein incorporated for all purposes.

Mineral oils for use as the base oil in this invention include, for example, paraffinic, naphthenic and other oils that are ordinarily used in lubricating oil compositions.

Vegetable oils may include, for example, canola oil or soybean oil.

Synthetic oils include, for example, both hydrocarbon synthetic oils and synthetic esters and mixtures thereof having the desired viscosity. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

The functional fluid of the present invention also contains a friction-modifying amount of the glycerol described herein. Typically, the total amount of glycerol contained in the functional fluid will be at least about 0.05 wt %. In other embodiments the functional fluid contains at least about 0.1 wt-% glycerol, or at least about 0.15 wt-% glycerol, or at least about 0.2 wt-% glycerol, or at least about 0.3 wt-% glycerol, or at least about 0.5 wt-% glycerol. Typically the functional fluid contains up to about 1 wt-% glycerol, or up to about 0.75 wt-% glycerol, or up to about 0.6 wt-% glycerol, or up to about 0.5 wt-%. In one embodiment, the functional fluid contains from about 0.05 wt. % to about 1 wt. % of glycerol; in another embodiment, from about 0.05 wt. % to about 0.3 wt. % of glycerol; and in another embodiment, from about 0.1 wt. % to about 0.3 wt. % of glycerol.

In one embodiment the functional fluid of the invention may also contain a glycerol fatty acid ester in addition to glycerol. When the glycerol fatty acid ester is contained in the functional fluid, the functional fluid contains glycerol and does not contain more than 0.5 wt-% of the glycerol fatty acid ester. In one embodiment, the functional fluid contains glycerol and does not contain more than 0.25 wt-% of the glycerol fatty acid ester; in one embodiment, the functional fluid contains glycerol and does not contain more than 0.20 wt-% of the glycerol fatty acid ester; in one embodiment, the functional fluid contains glycerol and does not contain more than 0.15 wt-% of the glycerol fatty acid ester; in one embodiment, the functional fluid contains glycerol and does not contain more than 0.10 wt-% of the glycerol fatty acid ester; and, in one embodiment, the functional fluid contains glycerol and does not contain more than 0.05 wt-% of the glycerol fatty ester.

A specific glycerol fatty acid ester is glycerol monooleate. For the purposes of this invention it is understood that glycerol monooleate refers to the commercial materials sold as glycerol monooleate that are the reaction product of commercially available glycerol and mixtures of fatty acids that are predominantly oleic acid. The reaction product generally contains a mixture of the mono-, di- and tri-ester, although the mono-ester is the predominant ester. Examples of commercial glycerol monoleate include Priolube™ 1408 and Radiasurf™ 7149 (i.e., esters of fatty acids including glycerol trioleate).

In one embodiment the functional fluid contains glycerol, but does not contain any of the glycerol fatty acid ester derivative.

In one embodiment, the glycerol fatty acid ester derivative is a mixture of glycerol mono-oleate, di-oleate and tri-oleate in which glycerol mono-oleate is the species with the highest concentration in the mixture. Typically, the mixture comprises about 40-60 wt % of glycerol mono-oleate.

In one embodiment the functional fluid of the invention may contain glycerol which is added into the functional fluid, or associated additive package, separately from any glycerol fatty acid ester derivative.

In one embodiment, the functional fluid of the present invention may also contain an alkanediol, preferably a 1,2-alkanediol. More preferred, the alkane constituent of the 1,2-alkanediol has 14 to 18 carbon atoms (i.e., a $C_{14}$-$C_{18}$ diol). Typically, the alkanediol is synthesized according to methods that are well known in the art, including, but not limited to oxidation of alkenes using an appropriate reagent; reaction between alkene and formaldehyde; and hydration of ketones.

Alternatively, the alkanediol may be purchased from Daicel Chemical Industries, Ltd., Tokyo, Japan.

In one embodiment the functional fluid of the present invention may also contain at least one low overbased detergent, at least one high overbased detergent and at least one antiwear additive.

The Overbased Detergent Additive

Overbased detergent additives are well known in the art and preferably are alkali or alkaline earth metal overbased detergent additives. Such detergent additives are prepared by reacting a metal oxide or metal hydroxide with a substrate and carbon dioxide gas. The substrate is typically an acid, usually an acid selected from the group consisting of aliphatic substituted sulfonic acids, aliphatic substituted carboxylic acids, and aliphatic substituted phenols.

The terminology "overbased" relates to metal salts, preferably, metal salts of sulfonates, carboxylates and phenates, wherein the amount of metal present exceeds the stoichiometric amount. Such salts are said to have conversion levels in excess of 100% (i.e., they comprise more than 100% of the theoretical amount of metal needed to convert the acid to its "normal", "neutral" salt). The expression "metal ratio", often abbreviated as MR, is used in the prior art and herein to designate the ratio of total chemical equivalents of metal in the overbased salt to chemical equivalents of the metal in a neutral salt according to known chemical reactivity and stoichiometry. Thus, in a normal or neutral salt, the metal ratio is one and in an overbased salt, MR, is greater than one. They are commonly referred to as overbased, hyperbased or superbased salts and are usually salts of organic sulfur acids, carboxylic acids, or phenols.

The overbased detergent typically has a metal to substrate ratio of at least 1.1:1, preferably at least 2:1, more preferably at least 4:1, or at least 10:1.

Sulfonic acids include the mono or polynuclear aromatic or cycloaliphatic compounds which, when overbased, are called sulfonates.

Specific examples of sulfonic acids useful in this invention are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono and polywax substituted sulfonic and polysulfonic acids of, e.g., benzene, naphthalene, phenol, diphenyl ether, naphthalene disulfide, diphenylamine, thiophene, alphachloronaphthalene, etc.; other substituted sulfonic acids such as alkyl benzene sulfonic acids (where the alkyl group has at least 8 carbons), cetylphenol monosulfide sulfonic acids, dicetyl thianthrene disulfonic acids, dilauryl beta naphthyl sulfonic acid, dicapryl nitronaphthalene sulfonic acids, and alkaryl sulfonic acids such as dodecyl benzene "bottoms" sulfonic acids.

The bottoms acids are derived from benzene that has been alkylated with propylene tetramers or isobutene trimers to introduce 1, 2, 3 or more branched chain $C_{12}$ substituents on the benzene ring. Dodecyl benzene bottoms, principally mixtures of mono and didodecyl benzenes, are available as byproducts from the manufacture of household detergents. Similar products obtained from alkylation bottoms formed during manufacture of linear alkyl sulfonates (LAS) are also useful in making the sulfonates used in this invention.

The production of sulfonates from detergent manufacture products by reaction with, e.g., $SO_3$, is well known to those skilled in the art. See, for example, the articles "Sulfonation and Sulfation", Vol. 23, pp. 146 et seq. and "Sulfonic Acids", Vol. 23, pp. 194 et seq, both in Kirk Othmer "Encyclopedia of Chemical Technology", Fourth Edition, published by John Wiley & Sons, N.Y. (1997).

Also included are aliphatic sulfonic acids containing at least about 7 carbon atoms, often at least about 12 carbon atoms in the aliphatic group, such as paraffin wax sulfonic acids, unsaturated paraffin wax sulfonic acids, hydroxy substituted paraffin wax sulfonic acids, hexapropylene sulfonic acids, tetraamylene sulfonic acids, polyisobutene sulfonic acids wherein the polyisobutene contains from 20 to 7000 or more carbon atoms, chloro substituted paraffin wax sulfonic acids, nitroparaffiin wax sulfonic acids, etc.; cycloaliphatic sulfonic acids such as petroleum naphthene sulfonic acids, cetyl cyclopentyl sulfonic acids, lauryl cyclohexyl sulfonic acids, bis(isobutyl)cyclohexyl sulfonic acids, etc.

With respect to the sulfonic acids or salts thereof described herein, it is intended that the term "petroleum sulfonic acids" or "petroleum sulfonates" includes all sulfonic acids or the salts thereof derived from petroleum products. A particularly valuable group of petroleum sulfonic acids are the mahogany sulfonic acids (so called because of their reddish brown color) obtained as a by-product from the manufacture of petroleum white oils by a sulfonic acid process.

Other descriptions of overbased sulfonate salts and techniques for making them can be found in the following U.S. Pat. Nos. 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,297; 2,315,514; 2,319,121; 2,321,022; 2,333,568; 2,333,788; 2,335,259; 2,337,552; 2,346,568; 2,366,027; 2,374,193; 2,383,319; 3,312,618; 3,471,403; 3,488,284; 3,595,790; and 3,798,012. Each of these patents is hereby incorporated by reference in its entirety.

In one embodiment, a low overbased detergent is employed. Preferably, the low overbased detergent is a low overbased sulfonate detergent. More preferred, the low overbased sulfonate detergent is a low overbased alkaline earth metal sulfonate detergent. Most preferred, the alkaline earth metal is selected from calcium, magnesium, sodium, strontium or barium. Even more preferred, the low overbased alkaline earth metal sulfonate detergent is a low overbased calcium sulfonate detergent.

In one embodiment, a medium overbased detergent is employed. Preferably, the medium overbased detergent is medium overbased calcium sulfonate.

Preferably, the high overbased detergent is a high overbased sulfonate detergent. More preferred, the high overbased sulfonate detergent is a high overbased alkaline earth metal sulfonate detergent. Most preferred, the alkaline earth metal is selected from calcium, magnesium, sodium or barium. Even more preferred, the high overbased alkaline earth metal sulfonate detergent is a high overbased calcium sulfonate detergent or a high overbased magnesium detergent.

In one embodiment, non-sulfonate containing detergents are employed. Such detergents include, but are not limited to, carboxylate and phenate detergents. These carboxylate detergents or phenate detergents or both may be in the functional fluid containing the glycerol additive.

Typical carboxylate detergents employed are those that are described in U.S. Pat. Nos. 7,163,911; 7,465,696 and the like which are herein incorporated by reference.

Typical phenate detergents employed are those that are described in U.S. Pat. No. 7,435,709 and the like, which are herein incorporated by reference.

Antiwear Additive

Examples of antiwear additives that may be employed in the present invention include zinc dialky-1-dithiophosphate (primary alkyl, secondary alkyl, and aryl type), diphenyl sulfide, methyl trichlorostearate, chlorinated naphthalene, fluoroalkylpolysiloxane, lead naphthenate, neutralized phosphates, dithiophosphates, and sulfur-free phosphates. Preferably, the antiwear additive is zinc dialkyl thiophospate. More preferred, the zinc dialkyl dithiophosphate is derived from a primary alcohol.

Besides the glycerol, the detergents and the antiwear additives employed in the functional fluid of the present invention, the functional fluid may also comprise other additives described below. These additional components can be blended in any order and can be blended as combinations of components.

Other Additive Components

The following additive components are examples of some of the components that can be favorably employed in the present invention. These examples of additives are provided to illustrate the present invention, but they are not intended to limit it:

A. Metal Detergents

Sulfurized or unsulfurized alkyl or alkenyl phenates, sulfonates derived from synthetic or natural feedstocks, carboxylates, salicylates, phenalates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic, acids, metal salts of an alkyl or alkenyl multiacid, and chemical and physical mixtures thereof.

B. Anti-Oxidants

Anti-oxidants reduce the tendency of mineral oils to deteriorate in service which deterioration is evidenced by the products of oxidation such as sludge and varnish-like deposits on the metal surfaces and by an increase in viscosity. Anti-oxidants may include, but are not limited to, such anti-oxidants as phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butyldene-bis(3-methyl-6-tert-butyl phenol), 4,4'-isopropylidene-bis(2,6-di-tert-bulylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-1-4-methylphenol, 2,6-di-tert-butyl-4-ethylphenol, 2,4-dimethyl-6-tert-butylphenol, 2,6-di-tert-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Diphenylamine-type oxidation inhibitors include, but are not limited to, alkylated diphenylamine, phenyl-.alpha.-naphthylamine, and alkylated-.alpha.-naphthylamine. Other types of oxidation inhibitors include metal dithiocarbamate (e.g., zinc dithiocarbamate), and methylenebis(dibutyidithiocarbamate). The antioxidant is generally incorporated into an oil in an amount of about 0 to about 10 wt %, preferably 0.05 to about 3.0 wt %, per total amount of the engine oil.

C. Anti-Wear/Extreme Pressure Agents

As their name implies, these agents reduce wear of moving metallic parts. Examples of such agents include, but are not limited to, phosphates, phosphites, carbamates, esters, sulfur containing compounds, molybdenum complexes, zinc dialkyldithiophosphate (primary alkyl, secondary alkyl, and aryl type), sulfurized oils, sulfurized isobutylene, sulfurized polybutene, diphenyl sulfide, methyl trichlorostearate, chlorinated naphthalene, fluoroalkylpolysiloxane, and lead naphthenate.

D. Rust Inhibitors (Anti-Rust Agents)

1) Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol monooleate, and polyethylene glycol monooleate.
2) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

E. Demulsifiers

Addition product of alkylphenol and ethylene oxide, polyoxyethylene alkyl ether, and polyoxyethylene sorbitan ester.

F. Friction Modifiers

Fatty alcohols, 1,2-diols, borated 1,2-diols, fatty acids, amines, fatty acid amides, borated esters, and other esters.

G. Multifunctional Additives

Sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

H. Viscosity Index Improvers

Polymethacrylate type polymers, ethylene-propylene copolymers, styrene-isoprene copolymers, hydrogenated styrene-isoprene copolymers, polyisobutylene, and dispersant type viscosity index improvers.

I. Pour Point Depressants

Polymethyl methacrylate.

J. Foam Inhibitors

Alkyl methacrylate polymers and dimethyl silicone polymers.

K. Metal Deactivators

Disalicylidene propylenediamine, triazole derivatives, mercaptobenzothiazoles, thiadiazole derivatives, and mercaptobenzimidazoles.

L. Dispersants

Alkenyl succinimides, alkenyl succinimides modified with other organic compounds, alkenyl succinimides modified by post-treatment with ethylene carbonate or boric acid, esters of polyalcohols and polyisobutenyl succinic anhydride, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants and the like or mixtures of such dispersants.

Additive Packages

In another embodiment, the invention is directed to additive concentrates for functional fluids that contain glycerol. The glycerol-containing concentrate may be provided as an additive package or concentrate which will be incorporated into a substantially inert, normally liquid organic diluent such as, for example, mineral oil, naphtha, benzene, toluene or xylene to form an additive concentrate. These concentrates usually contain from about 1% to about 99% by weight, and in one embodiment about 10% to about 90% by weight of such diluent. Typically, a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used.

EXAMPLES

The invention will be further illustrated by the following examples, which set forth particularly advantageous method embodiments. While the Examples are provided to illustrate the present invention, they are not intended to limit it. This application is intended to cover those various changes and substitutions that may be made by those skilled in the art without departing from the spirit and scope of the appended claims.

Example A

A baseline formulation was prepared which contained:

(i) 1.82 wt % of a 27 TBN oil concentrate of a Ca sulfonate detergent;

(ii) 1.89 wt % of a 320 TBN oil concentrate of a Ca sulfonate detergent;

(iii) 1.44 wt-% of an oil concentrate of a zinc dithiophosphate derived from a primary alcohol containing 7.3 wt % phosphorous; and (iv) the balance, a Group II base oil.

Example B (Comparative)

A lubricating oil composition was prepared by top-treating the baseline formulation of Example A with 0.5 wt. % of a molybdenum dithiocarbamate (available commercially from Asahi Denka Kogyo K.K. as ADEKA SAKURALUBE 505).

Example C (Comparative)

A lubricating oil composition was prepared by top-treating the baseline formulation of Example A with 0.5 wt. % of a sodium borate dispersion.

Example D (Comparative)

A lubricating oil composition was prepared by top-treating the baseline formulation of Example A with 0.5 wt. % of a diethoxylate of tallow amine (available commercially from Huntsman as SURFONIC T-2).

Example E (Comparative)

A lubricating oil composition was prepared by top-treating the baseline formulation of Example A with 0.5 wt. % of a glycerin oleyl ether (available commercially from Asahi Denka Kogyo K.K. as ADEKA FM-618C).

Example F (Comparative)

A lubricating oil composition was prepared by top-treating the baseline formulation of Example A with 0.5 wt. % of a mixture of $C_{16}$ and $C_{18}$ 1,2-hydroxyalkanes (available commercially from Asahi Denka Kogyo K.K. (Tokyo, Japan) as ADEKA ECOROYAL FMD-168).

Example G (Comparative)

A lubricating oil composition was prepared by top-treating the baseline formulation of Example A with 1.0 wt. % of ADEKA ECOROYAL FMD-168, which may be purchased from Asahi Denka Kogyo K.K. (Tokyo, Japan).

Example H (Comparative)

A lubricating oil composition was prepared by top-treating the baseline formulation of Example A with 0.5 wt. % of glycerol mono-oleate.

Example I (Comparative)

A lubricating oil composition was prepared by top-treating the baseline formulation of Example A with 0.3 wt. % of ethylene glycol.

Example J (Comparative)

A lubricating oil composition was prepared by top-treating the baseline formulation of Example A with 0.5 wt. % 1,3-butanediol.

Example 1

A lubricating oil composition was prepared by top-treating the baseline formulation of Example A with 0.3 wt. % of glycerol.

Example 2

A lubricating oil composition was prepared by top-treating the baseline formulation of Example A with 0.15 wt. % of glycerol.

Evaluation of Slow Speed Gear Performance

Slow speed gear performance is evaluated using ZF Group's ZF V3 test. In this test, an FZG stand is operated for 120 hours under controlled conditions of speed (9 rpm input speed, 13 rpm pinion speed), load (tenth stage) and temperature (90° C. for 40 hours, 120° C. for 40 hours and 90° C. for 40 hours). The test gears are lubricated with the test oil. The gear and pinion are weighed before and after the test. The gear weight loss and pinion weight loss are used to evaluate the wear obtained with the test fluid. In order to pass the test, the total weight loss (gear weight loss+pinion weight loss) must be less than 30 mg.

Slow speed gear performance results are presented in Tables 1, 2 and 2a. Test results from lubricating oil compositions containing a variety of different friction modifiers are included for comparison purposes. If the test resulted in a total weight loss of more than 30 mg at 80 hours, the test was discontinued.

TABLE 1

S19-5 Slow Speed Gear Performance Results

| | Friction Modifier/ Wear Inhibitor | Amount In Finished Oil (wt. %) | Total Weight Loss at 80 hr (mg) | Total Weight Loss at 120 hr (mg) | Pass/ Fail |
|---|---|---|---|---|---|
| Ex. B | MoDTC | 0.5 | 795 | — | Fail |
| Ex. C | Sodium borate dispersion | 0.5 | 403 | — | Fail |
| Ex. D | Tallow amine diethoxylate | 0.5 | 239 | — | Fail |
| Ex. E | Glycerin oleyl ether | 0.5 | 185 | — | Fail |
| Ex. F | $C_{16}$ & $C_{18}$ 1,2-alkanediols | 0.5 | 40 | — | Fail |

TABLE 1-continued

S19-5 Slow Speed Gear Performance Results

| | Friction Modifier/ Wear Inhibitor | Amount In Finished Oil (wt. %) | Total Weight Loss at 80 hr (mg) | Total Weight Loss at 120 hr (mg) | Pass/ Fail |
|---|---|---|---|---|---|
| Ex. G | $C_{16}$ & $C_{18}$ 1,2-alkanediols | 1.0 | 31 | 36 | Fail |
| Ex. H | Glycerol mono-oleate | 0.5 | 10 | — | Pass |
| Ex. I | Ethylene Glycol | 0.3 | 66 | 74 | Fail |
| Ex. J | 1,3 Butanediol | 0.5 | 346 | 471 | Fail |
| Ex. 1 | Glycerol | 0.3 | 9 | 12 | Pass |
| Ex. 2 | Glycerol | 0.15 | 5 | 9 | Pass |

The test results demonstrate that only glycerol and glycerol mono-oleate were able to pass the S19-5 slow speed gear test against a wide variety of friction modifiers thereby providing an alternative friction modifier to glycerol mono-oleate.

Example K

A baseline formulation was prepared which contained:

(i) 2.00 wt % of a 114 TBN oil concentrate of a sulfurized Ca phenate detergent;

(ii) 1.28 wt % of a 150 TBN oil concentrate of a Ca carboxylate detergent;

(iii) 1.50 wt-% of an oil concentrate of a zinc dithiophosphate derived from a primary alcohol containing 7.3 wt % phosphorous; and (iv) the balance, a Group II base oil.

Example L

A lubricating oil composition was prepared by top-treating the baseline formulation of Example K with 0.3 wt. % of glycerol monooleate.

Example 3

A lubricating oil composition was prepared by top-treating the baseline formulation of Example K with 0.1 wt. % of glycerol.

Example 4

A baseline formulation was prepared which contained:

(i) 1.00 wt % of an ethylene carbonate treated dispersant;

(ii) 1.67 wt % of a 263 TBN of oil concentrate of a calcium phenate detergent;

(iii) 0.79 wt % of a 320 TBN of oil concentrate of a calcium sulfonate detergent (iv) 1.28 wt-% of an oil concentrate of a zinc dithiophosphate derived from a primary alcohol containing 7.3 wt % phosphorous;

(v) 1.00 wt % of a seal swell agent;

(vi) 20 ppm of a foam inhibitor;

(vii) 0.50 wt % of polymethylacrylate and (viii) the balance, a Group II base oil.

A lubricating oil composition was prepared by top-treating the baseline formulation of Example 4 with 0.10 wt % of glycerol.

Example 5

A baseline formulation was prepared which contained:

(i) 3 ppm of a foam inhibitor;

(ii) 1.88 wt % of a 425 TBN oil concentrate of a calcium sulfonate detergent;

(iii) 1.28 wt-% of an oil concentrate of a zinc dithiophosphate derived from a primary alcohol containing 7.3 wt % phosphorous; and (iv) the balance, a Group II base oil.

A lubricating oil composition was prepared by top-treating the baseline formulation of Example 5 with 0.05 % of glycerol.

Example 6

A baseline formulation was prepared which contained:

(i) 0.1 wt % of a 395 TBN oil concentrate of a magnesium sulfonate detergent;

(ii) 2.52 wt % of a 320 TBN oil concentrate of a calcium sulfonate detergent;

(iii) 1.23 wt % of a 27 TBN concentrate of a calcium sulfonate detergent (iv) 1.53 wt-% of an oil concentrate of a zinc dithiophosphate derived from a primary alcohol containing 7.3 wt % phosphorous;

(v) 0.7 wt % of a seal swell agent;

(vi) 30 ppm of a foam inhibitor;

(vii) 0.035 wt % of thiadiazole and (viii) the balance, a Group II base oil.

A lubricating oil composition was prepared by top-treating the baseline formulation of Example 6 with 0.05 wt % of glycerol.

Example 7

A baseline formulation was prepared which contained:

(i) 2.52 wt % of a 320 TBN oil concentrate of a calcium sulfonate detergent;

(ii) 1.23 wt % of a 21 TBN oil concentrate of a calcium sulfonate detergent (iii) 1.53 wt-% of an oil concentrate of a zinc dithiophosphate derived from a primary alcohol containing 7.3 wt % phosphorous;

(iv) 0.7 wt % of a seal swell agent;

(v) 30 ppm of a foam inhibitor;

(vi) 0.035 wt % of thiadiazole;

(vii) 0.5 olelyl amide and (viii) the balance, a Group II base oil.

A lubricating oil composition was prepared by top-treating the baseline formulation of Example 7 with 0.05 wt % of glycerol.

TABLE 2

S19-5 Slow Speed Gear Performance Results

| | Friction Modifier/ Wear Inhibitor | Amount In Finished Oil (wt. %) | Total Weight Loss at 80 hr (mg) | Total Weight Loss at 120 hr (mg) | Pass/ Fail |
|---|---|---|---|---|---|
| Ex. L | Glycerol mono-oleate | 0.3 | 214 | 386 | Fail |
| Ex. 3 | Glycerol | 0.1 | 18 | 28 | Pass |
| Ex. 4 | Glycerol | 0.1 | 14 | 18 | Pass |
| Ex 5 | Glycerol | 0.05 | 8 | 8 | Pass |
| Ex. 6 | Glycerol | 0.05 | 4 | 5 | Pass |
| Ex. 7 | Glycerol | 0.05 | 18 | 19 | Pass |

The lubricating oils of Examples 3 -7 show that lubricating oils containing glycerol and various detergent additives results in a low total weight loss at 80 hours and 120 hours.

Based upon the results, the use of glycerol in amounts less than that of glycerol mono-oleate gives good friction modifying results.

Example 8

A baseline formulation was prepared which contained:
(i) 0.5 wt % of a 263 TBN oil concentrate of a calcium phenate detergent;
(ii) 2.0 wt % of a 350 TBN oil concentrate of a calcium sulfonate detergent
(iii) 1.28 wt-% of an oil concentrate of a zinc dithiophosphate derived from a primary alcohol;
(iv) 0.15 wt % glycerol;
(v) 0.5 wt % of a $C_{14}$-$C_{18}$ diol
(vi) 20 ppm of a foam inhibitor;
(ix) 1.8 wt % viscosity index improver;
(x) 0.2 wt % pour point depressant and
(xi) the balance, a Group II base oil.

TABLE 2a

S19-5 Slow Speed Gear Performance Results at 40 h, 80 h and 120 h.

| | Friction Modifier/ Wear Inhibitor | Glycerol In Finished Oil (wt. %) | Weight Loss (mg) @ 40 h | Weight Loss (mg) @ 80 h | Weight Loss (mg) @ 120 h | Pass/ Fail |
|---|---|---|---|---|---|---|
| Ex. 8 | Glycerol | 0.15 | 1 | 6 | 9 | Pass |

Example 8 shows that the combination of glycerol and a $C_{14}$-$C_{18}$ diol in a lubricating oil composition results in the lubricating oil composition that passes the S19-5 Slow Speed Gear Performance test. It is clear that the combination of glycerol and $C_{14}$-$C_{18}$ diol provides good gear wear results with a loss of no more than 10 mg at the maximum number of hours that the test was run (i.e., 120 hours).

Example N

A baseline formulation was prepared which contained:
(i) 0.05 wt % of a 395 TBN oil concentrate of a magnesium sulfonate detergent;
(ii) 2.52 wt % of a 320 TBN oil concentrate of a calcium sulfonate detergent;
(iii) 1.23 wt % of a 21 TBN oil concentrate of a calcium sulfonate detergent
(iv) 1.53 wt-% of an oil concentrate of a zinc dithiophosphate derived from a primary alcohol containing 7.3 wt % phosphorous;
(v) 0.5 wt % of a seal swell agent;
(vi) 20 ppm of a foam inhibitor;
(vii) 0.04 wt % of thiadiazole;
(viii) 0.5 olelyl amide;
(ix) 3.0 wt % viscosity index improver;
(x) 0.2 wt % pour point depressant and
(xi) the balance, a Group II base oil.

Example 9

A lubricating oil composition was prepared by top-treating the baseline formulation of Example N with 0.20 wt % of glycerol and 0.25 wt % glycerol mono-oleate.

Example O

A lubricating oil composition was prepared by top-treating the baseline formulation of Example N with 0.25 wt % glycerol mono-oleate.

The lubricating oils in Examples 9 and O were evaluated according to JDQ-95 Spiral Bevel and Final Drive Gear Wear which compared the lubricating oils of Examples 9 and O with a reference oil. In particular, the scoring of the gears was evaluated to determine wear. The test procedure duration is 50 hours. The test may be may be performed at Southwest Research Institute, San Antonio, Tex., U.S.A.

TABLE 3

| | Friction Modifier/ Wear Inhibitor | Glycerol In Finished Oil (wt. %) | Glycerol mono-oleate in Finished Oil (wt %) | JDQ95 (using merit rating system) | Pass/ Fail |
|---|---|---|---|---|---|
| Ex. 9 | Glycerol/ Glycerol mono-oleate | 0.20 | 0.25 | 9[1] | Pass |
| Ex. O | Glycerol mono-oleate | 0 | 0.25 | 4[2] | Fail |

[1]Rating at 50 test hours.
[2]Rating at 2 test hours.

Example 9 shows that an added amount of glycerol to a lubricating oil composition that already comprises glycerol mono-oleate results in passing JDQ95. By contrast, the lubricating oil that only contained glycerol mono-oleate failed the JDQ95 test after only two hours of the test. It is clear that a combination of glycerol and glycerol mono-oleate provides good gear wear results.

What is claimed is:

1. A tractor hydraulic fluid comprising
a. a major amount of an oil of lubricating viscosity
b. at least about 0.05 wt % glycerol;
c. 1.23 to 5.0 wt % of at least one low overbased sulfonate detergent;
d. 0.1 to 5.0 wt % of at least one high overbased sulfonate detergent;
e. 2.0 to 3.0 wt % of at least one medium overbased phenate detergent;
f. 0.5 to 3.0 wt % of at least one high overbased phenate detergent;
g. 1.28 to 2.0 wt % of at least one medium overbased carboxylate detergent and
h. at least one antiwear additive.

2. The tractor hydraulic fluid of claim 1 wherein the tractor hydraulic fluid also contains from 0.5 to 1.0 wt. % of a $C_{14}$-$C_{18}$ diol.

3. The tractor hydraulic fluid of claim 1 wherein the tractor hydraulic fluid also contains a glycerol monooleate.

4. The tractor hydraulic fluid of claim 3 wherein the tractor hydraulic fluid does not contain more than 0.5 wt-% of glycerol monooleate.

5. The tractor hydraulic fluid of claim 1 wherein the tractor hydraulic fluid also contains at least one detergent.

6. The tractor hydraulic fluid of claim 5 wherein the detergent is an alkaline earth metal detergent.

7. The tractor hydraulic fluid of claim 6 wherein the alkaline earth metal detergent further comprises at least one low overbased sulfonate, at least one medium overbased sulfonate, at least one high overbased sulfonate, or at least one non-sulfonate detergent.

8. The tractor hydraulic fluid of claim 7 wherein the alkaline earth metal earth detergent is a low overbased sulfonate.

9. The tractor hydraulic fluid of claim 8 wherein the low overbased sulfonate is a low overbased calcium sulfonate.

10. The tractor hydraulic of claim 7 wherein the non-sulfonate detergent is at least one phenate detergent or at least one carboxylate detergent.

11. The tractor hydraulic fluid of claim 7 wherein the high overbased sulfonate is a high overbased calcium sulfonate.

12. The tractor hydraulic fluid of claim 1 wherein the at least one antiwear additive is zinc dialkyl dithiophosphate.

13. The tractor hydraulic fluid of claim 12 wherein the zinc dialkyl dithiophosphate is derived from a primary alcohol.

14. The tractor hydraulic fluid of claim 1 wherein the amount of glycerol in the tractor hydraulic fluid is from about 0.05 to about 1.0 wt %.

15. The tractor hydraulic fluid of claim 14 wherein the amount of glycerol in the tractor hydraulic fluid is from about 0.1 to about 0.3 wt %.

16. A method of reducing friction comprising contacting a metal surface with a tractor hydraulic fluid of claim 1.

* * * * *